US005197933A

United States Patent [19]

Waters

[11] Patent Number: 5,197,933

[45] Date of Patent: Mar. 30, 1993

[54] THROWING ARM EXERCISING MACHINE

[76] Inventor: Tommy R. Waters, 5003 37th Ave., Meridian, Miss. 39305

[21] Appl. No.: 749,699

[22] Filed: Aug. 26, 1991

[51] Int. Cl.[5] ..... A63B 21/062

[52] U.S. Cl. ..... 482/101; 482/99; 273/191 R; 273/191 A

[58] Field of Search ..... 482/20, 133, 134, 135, 482/92, 93, 94, 97, 98, 99, 101, 102, 114, 129, 139, 136, 914; 273/191 A, 191 B, 191 R, 26 R; 272/143, 131, 117

[56] References Cited

U.S. PATENT DOCUMENTS 3,966,203 6/1976 Bickford ..... 273/191 B
4,149,713 4/1979 McLead ..... 482/101

FOREIGN PATENT DOCUMENTS 949993 6/1974 Canada ..... 273/29.3

*Primary Examiner*—Richard J. Apley
*Assistant Examiner*—Jerome Donnelly
*Attorney, Agent, or Firm*—George A. Bode; Michael L. Hoelter

[57] ABSTRACT

This invention pertains to a throwing arm exercising machine that not only strengthens the throwing arm of the user, but also instructs the user as to the proper form for throwing. It encompasses a frame having an overhead track upon which a handle slides. A counterweight is secured to this handle so as to resist the movement of this handle along the track. A user positions himself underneath the track and grasps the handle and, by moving the handle along the track against the bias of the counterweight, exercises his throwing arm. Additionally, this throwing arm is strengthened while the proper form for throwing is practiced due to the track conforming to such form. For user stability and to isolate the throwing muscles, a hand grip for the non-throwing hand is provided for the user to grasp during this exercise.

12 Claims, 3 Drawing Sheets

THROWING ARM EXERCISING MACHINE

BACKGROUND OF THE INVENTION

1. Field of the Invention

This invention pertains to exercising machines in general and more particularly, to a device that strengthens the throwing arm of a user by isolating it in addition to providing guidance as to the proper form necessary for maximum output.

2. General Background

There are many devices available to aid in the strengthening of throwing arms. Some typical devices are shown in U.S. Pat. Nos. 3,652,085 to Cole; 4,592,545 to Sagedahl, et al.; 4,846,471 to Haysom; and 4,974,836 to Hirsch. Each of these disclose a ball (such as a baseball) that is moved by the user against resistance to increase the strength of the throwing arm. In some of these cases, the ball is attached to a counterweight while in others, the ball is attached to an elastic strap that is stretched to exercise the arm. While it can be presumed that by using these devices, the user may increase his or her strength, none of these devices aid the user in perfecting his or her form for throwing. This is because these devices provide no guidance to the user as to the proper motion or form needed to achieve maximum efficiency and result, nor do they isolate the user's throwing muscle group. Should a user choose to utilize one of these devices, the user is allowed to move his or her arm in a variety of different motions at a variety of different angles. No one motion will be emphasized over another, thus these devices really do the user a disservice in that they strengthen the arm but they do not teach the user which motion is the preferred motion or which one is the optimal one.

Ideally, then, what is needed is an exercising machine that not only increases the strength of the throwing arm, but also provides guidance as to the proper form for throwing. It is thus an object of this invention to provide such an apparatus. Another object of this invention is to provide such a machine that can be used by right-handed throwers as well as left-handed throwers. Still another object of this invention is to provide a machine whose counterweight can be increased or decreased as needed, and one whose biasing force remains constant throughout the entire range of motion. A further object of this invention is to provide an exercising device that can be used by an person regardless of height. Still another object of this invention is to provide an exercising machine that isolates the user's throwing muscles. These and other objects will become obvious upon further investigation.

SUMMARY OF THE PRESENT INVENTION

The preferred embodiment of the apparatus of the present invention solves the aforementioned problems in a straightforward and simple manner. What is disclosed herein is a throwing arm exercising machine having a frame that is configured with front and back uprights and an overhead track supported between the two. Handle means are secured to this track and are configured to slide or move along the track. The suspended end of the handle means is designed to be grasped by the throwing hand of the user. A counterweight is secured adjacent one upright and is configured to apply a resistance or bias against the movement of the handle means along the track. To increase user stability during exercising, a hand or isolation grip is secured to the frame so that the user may grasp it with the non-throwing hand, this grip also aids in isolating and exercising the throwing muscles. Thus, when properly positioned, the user grasps the handle means and hand grip and, against the bias of the counterweight, moves the handle means along the track.

BRIEF DESCRIPTION OF THE DRAWING

For a further understanding of the nature and objects of the present invention, reference should be had to the following description taken in conjunction with the accompanying drawing in which like parts are given like reference numerals and, wherein.

DETAILED DESCRIPTION OF THE PREFERRED EMBODIMENT

Figure 1:
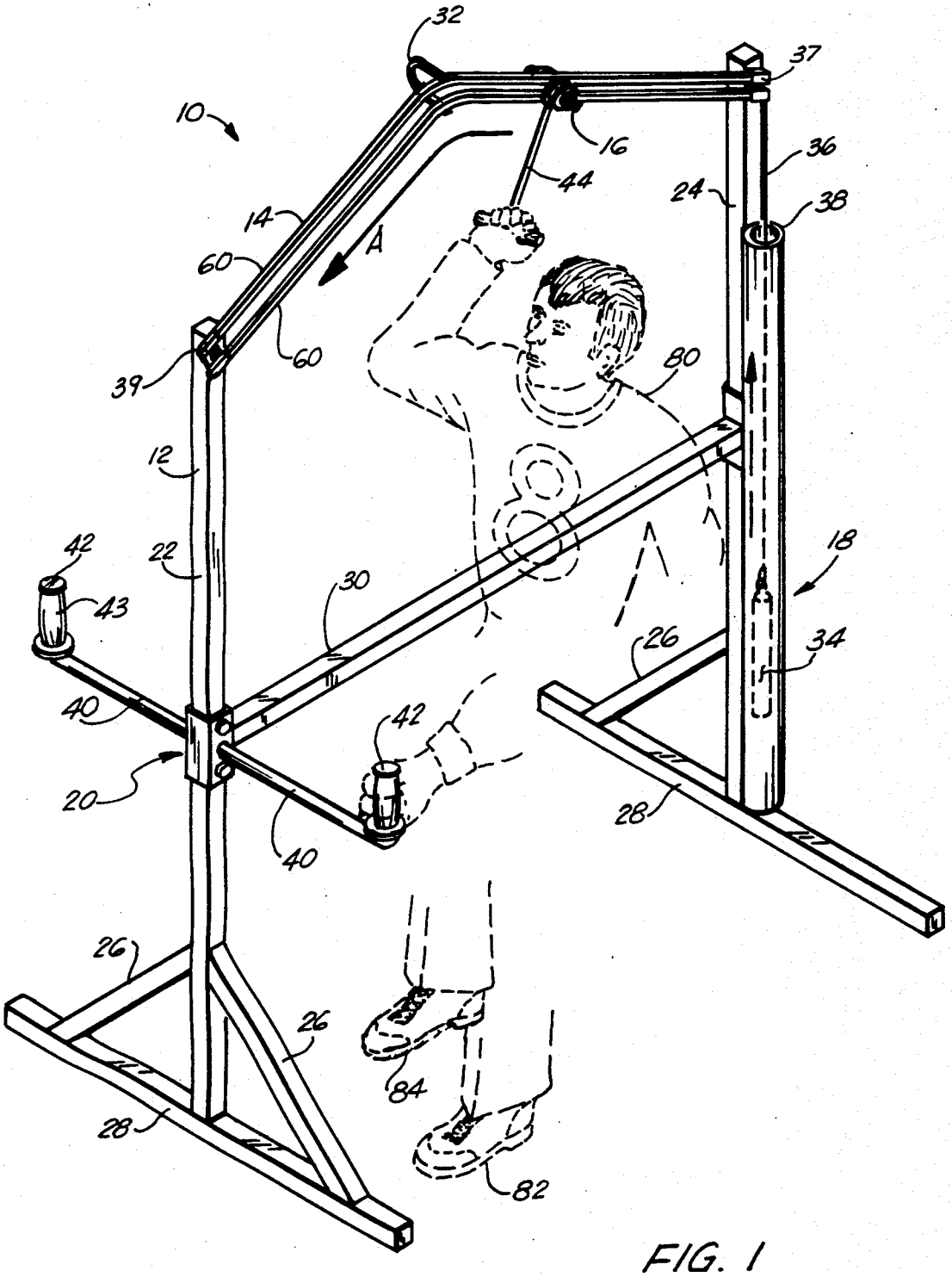
FIG. 1 is a top perspective elevational view, partially broken away, of the invention in use (with the user in phantom)
Figure 2:
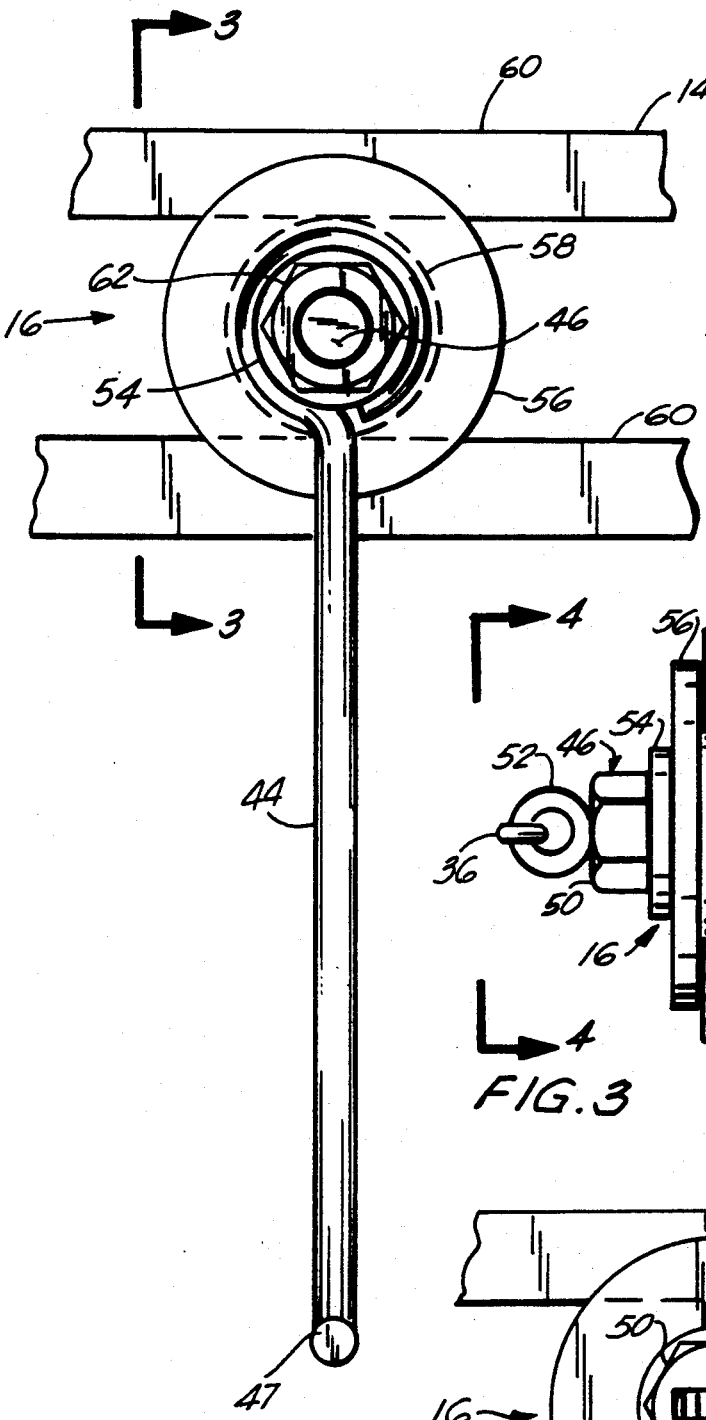
FIG. 2 is an enlarged side view of the T-grip handle assembly taken along Lines 2—2 of FIG. 3.

Referring now to the drawings, and in particular FIG. 1, there is shown throwing arm exercising machine 10. As illustrated, machine 10 comprises frame 12 with overhead arcuate track 14 within which Tgrip handle assembly 16 moves. Counterweight means 18 are provided which connect to T-grip handle assembly 16 thereby providing some resistance to the movement of assembly 16 upon track 14. To assist in stabilizing the user 80 during use and to position the user 80 correctly, a front hand or isolation grip means 20 is provided for the hand not gripping T-grip handle assembly 16.

Frame 12 consists of front and back uprights 22, 24, respectively, which are braced to horizontal base members 28 by angulated bracing means 26 for greater strength and stability. It has been found advisable to support exercising machine 10 upon horizontal members 28 that extend both parallel to the ground and generally perpendicular to the direction of the throw. This will prevent any sideways rocking or motion of apparatus 10 during use. Uprights 22 and 24 are secured together from their respective mid-region areas by horizontal strut 30 which also helps position the user 80 correctly with respect to machine 10. Strut 30 prevents the user 80 from being positioned too far underneath track 14 during operation.

Track 14 is shown in FIG. 1 as being secured between the upper regions of uprights 22 and 24. This also provides a degree of stability to machine 10. Track 14 is curved so as to closely conform to the correct throwing motion being practiced, be it baseball, football or some other sport. In this fashion, the user can gain both strength and correct form during the same exercising session. U-brace 32, secured to a mid-region of track 14, maintains the proper spacing or alignment of track 14 while also providing stability to the structure.

Positioned adjacent to back upright 24 are counterweight means 18 which consists generally of one of a series of removable weights 34 secured to one end of cable 36. The other end of cable 36 is secured to T-grip handle assembly 16 after passing over pulley 37 provided in track 14. Several pulleys can be provided in track 14 (as needed). Pulley 37 also functions as means for limiting the rearward movement of assembly 16 within track 14. The movement of assembly 16 in the forward direction (that of ARROW A in FIG. 1) is limited by stop 39 which can be a bolt extending through upright 22 and between rails 60. Of course, the length of cable 36 can also limit the range of motion of assembly 16. For safety and protection, counterweight means 18 also incorporates protective sleeve or guide 38 that is mounted on upright 24 and encloses weight 34 during its up and down movement along or adjacent upright 24. As can be imagined, the amount of counterweight provided by counterweight means 18 is adjustable from as little as one pound or less to nearly the maximum weight which cable 36 and machine 10 can bear, provided, of course, that such large amounts can be installed upon machine 10. Generally, however, the amount of counterweight provided is between three pounds and twenty pounds.

Attached to a mid-region of front upright 22 is hand or isolation grip means 20. In this embodiment, hand grip means 20 is secured to upright 22 at the same connection which joints strut 30 to upright 22, however, this need not always be the case. Hand grip means 20 consists of a pair of horizontal members 40 which extend in opposite directions transverse to front upright 22. The extended end of each member 40 is turned upward as shown so as to provide grips 42 to accommodate the user 80. These upwardly turned ends or grips 42 are also usually provided with padding 43 for the user's comfort and safety. During use, the user's non-throwing hand would grasp the appropriate grip 42 to both stabilize or balance the user and also to maintain the proper position of the user 80 with respect to exercising machine 10. This grip means 20 also enables the user 80 to isolate or focus upon the throwing muscles for specific attention and exercise without as much emphasis being placed upon other muscle groups. Since hand grip means 20 has horizontal members which extend outwardly from both sides of front upright 22, hand grip means 20 is able to accommodate both right-handed and left-handed users.

While the operation of T-grip handle assembly 16 is shown in FIG. 1, its construction is better illustrated in FIGS. 2 through 5. As illustrated, T-grip handle assembly 16 consists of pivotal T-bar 44 suspended from track 14. While one end 47 of T-bar 44 is shown as being T-shaped, other configurations are also likely, such a L-shaped, U-shaped, or even a flexible strap. In any event, for further description purposes, bar 44 will be referred to as T-bar 44, but it is not to be limited to a T-bar shape. The opposite end of T-bar 44 is configured as a loop 45 through which pin or bolt 46 freely passes. It is essential that T-bar 44 freely pivot about pin 46 for proper operation of exercising machine 10.

Figure 3:
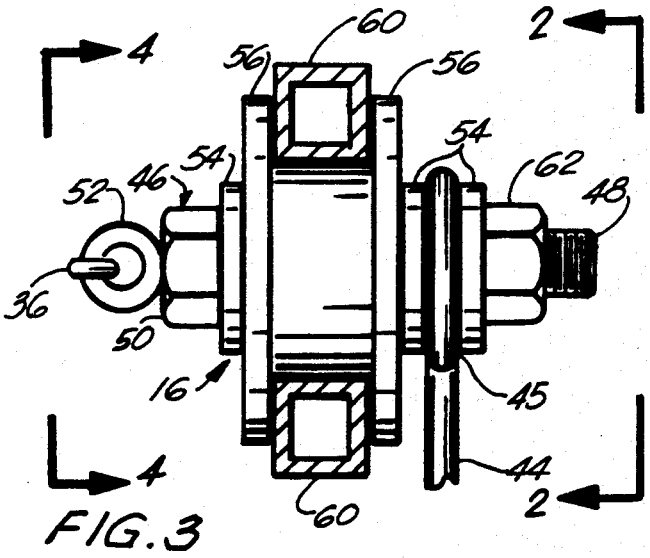
FIG. 3 is s sectional view of the T-grip handle assembly taken along Lines 3—3 of FIG. 2.
Figure 4:
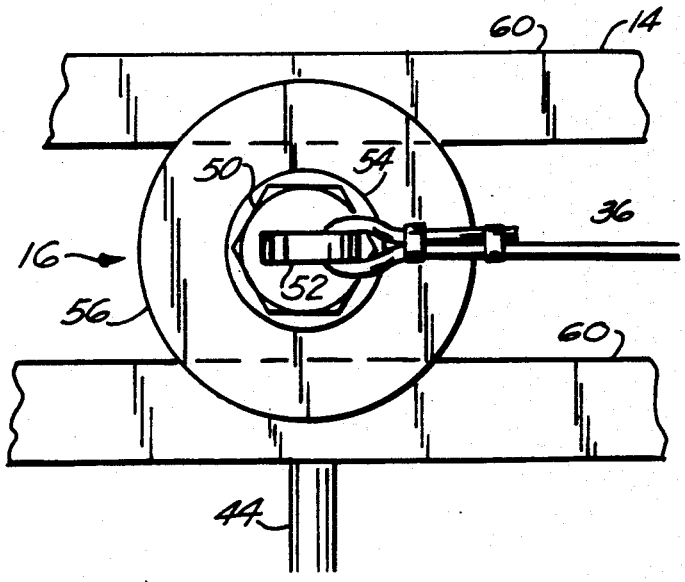
FIG. 4 is an enlarged side view of the T-grip handle assembly taken along lines 4—4 of FIG. 3; and, FIG. 5 is an exploded view of the T-grip handle assembly illustrating its various components.
Figure 5:
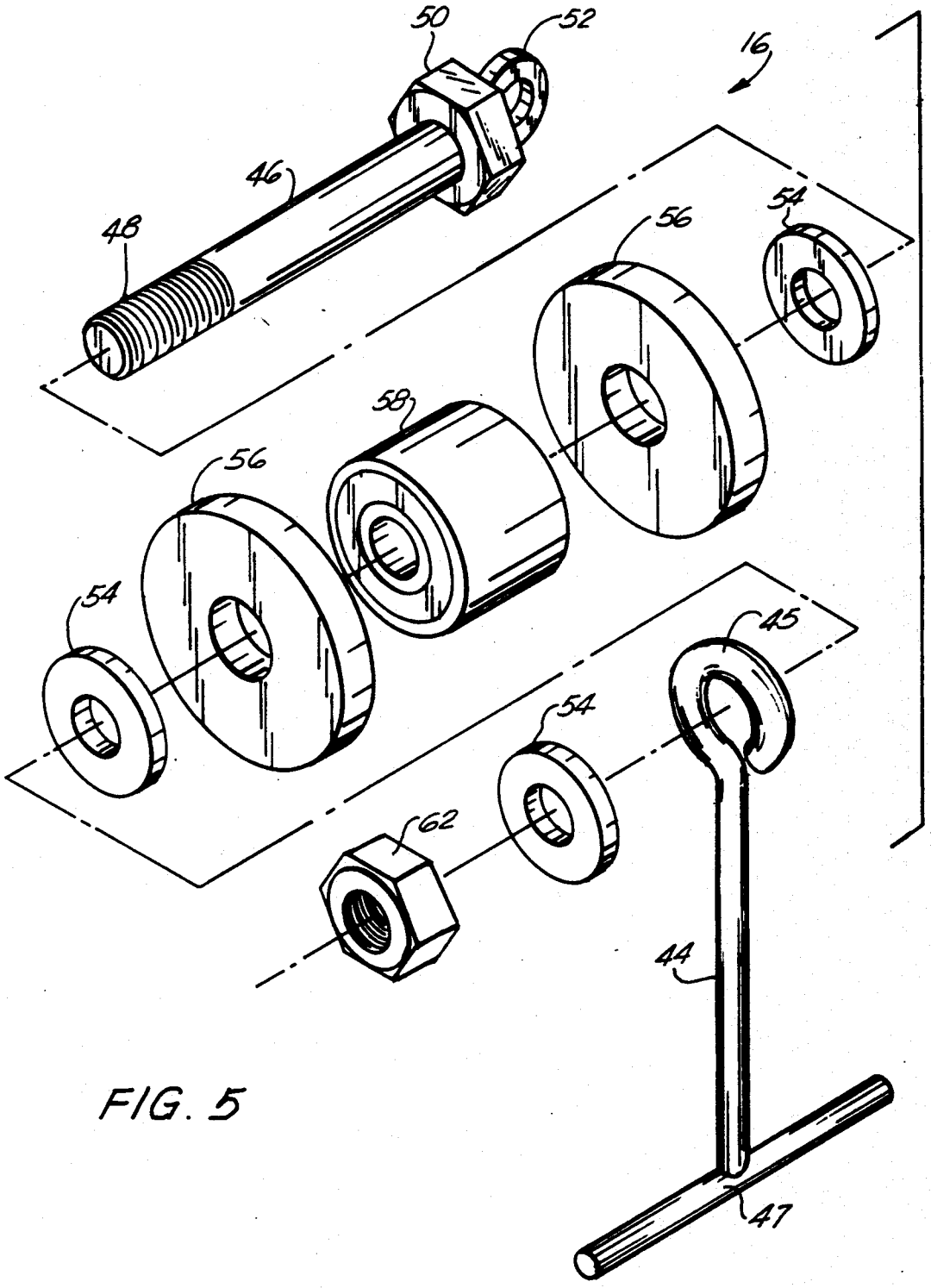

Pin 46 is configured with threads 48 along one end region and with a stop 50 formed at the other end region. A cable connector 52 is formed with or attached to stop 50 with cable connector 52 being used to attach cable 36 to T-grip handle assembly 16. As shown in both FIGS. 3 and 5, one of flat washers 54 slides on to pin 46 and rests against stop 50. One of larger nylon washers 56 is then positioned on pin 46 and placed against flat washer 54. Both flat washer 54 and nylon washer 56 are sized so as to prevent pin 46 from being pulled through track 14. A sealed bearing or spacer 58 is then mounted on pin 46 and positioned within track 14 as shown in FIGS. 1 and 3. Bearing 58 is sized to closely fit between the spaced rails 60 of track 14 while also enabling T-grip handle assembly 16 to slide along track 14. To retain bearing 58 in place between rails 60, another nylon washer 56 is positioned on the other side of bearing 58. Thus, bearing 58 is journalled in place between rails 60 between nylon washers 56 positioned outside of rails 60, thereby permitting T-grip handle assembly 16 to freely travel along track 14. Next to this latest nylon washer 56 on pin 46 is mounted another flat washer 54 which is used as a spacer between T-bar 44 and track 14. On the opposite side of T-bar 44 is another flat washer 54 which is snugly tightened against T-bar 44 via nut 62 which screws onto threads 48. By this construction, T-bar 44 is able to rotate about pin 46 between flat washers 54 while bearing 58 is able to move along track 14 between nylon washers 56 and rails 60.

Returning to FIG. 1, throwing arm exercising machine 10 is operated by having the user 80 stand next to the mid-region of strut 30. The user 80 may position himself on either the right or left side of strut 30, depending on his preference; but, to further the explanation of machine 10, it will be presumed that the user 80 is right-handed and, therefore, located on the left side of strut 30 as shown in FIG. 1. In this position, the user 80 would grasp T-grip handle assembly 16 with his right hand and handle 42 of hand grip means 20 with his left hand. While in this position, the user's left foot 82 is to be placed slightly ahead of the user's right foot 84 just as would occur during an actual throw. Prior to taking up such a position, the user 80 will have installed the desired amount of weight 34 upon cable 36. Thus, whenever the user 80 moves T-grip handle assembly 16 from a rear position to a forward position (in the direction of ARROW A), the right (throwing) arm of the user will be exercised. Additionally, because of the curvature of track 14, the proper form for throwing will also be reinforced or trained. Again, different curvatures of track 14 are possible depending upon the throwing form that is to be exercised.

While it might be preferable to configure track 14 such that it is vertically movable so as to accommodate a variety of differently sized users, this need not always be the case. Due to the pivotable nature of T-bar 44, both large and small users are able to exercise on machine 10. The only difference being that the smaller person may have to be re-positioned slightly forward or slightly rearward of where the larger person might stand. The length of track 14 is long enough to accommodate both such users regardless of the length of their arms.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. An arm exercising machine comprising:

(a) a frame member having spaced apart front and rear upright members and an arcuate overhead track therebetween;

(b) means partially secured within said track for movement therealong, a portion thereof being adapted to be grasped by the throwing hand of the user;

(c) means secured to and positioned adjacent said rear upright members for selectively applying a counterweight to said means for movement secured within said track, said means for applying said counterweight comprising:

(i) a cable, having proximate and distal ends, mounted over a pulley, said means for movement being securable to to said proximate end of said cable and said counterweight, which comprises one of a series of removable weights, being securable to said distal end of said cable; and, (ii) a cylindrical sleeve within which said counterweight is housed; and, (d) means secured to said front upright member and extending generally perpendicular thereto and adapted for gripping by the other hand of said user, whereby said user grasps said portion of said means secured within said track and, against the bias of said counterweight, moves said means secured within said track along said track.

2. The apparatus of claim 1, wherein said track is curved so as to conform to the throwing motion to be practiced by the user.

3. The apparatus of claim 1, wherein said track includes a pair of spaced apart rails between which said means move.

4. The apparatus of claim 1, further comprising a generally horizontal strut secured to each of said upright members, whereby the user positions himself adjacent said strut during use.

5. The apparatus of claim 1, wherein the perpendicularly extended end of said gripping means is provided with padding for gripping by the user's non-throwing hand.

6. The apparatus of claim 1, wherein said pulley is mounted to the upper portion of said rear upright member.

7. An arm exercising machine comprising:

(a) a frame member having spaced apart front and rear upright members and an arcuate overhead track, including a pair of spaced apart rails, therebetween;

(b) means partially journalled between said spaced apart rails of said track for movement therealong, a portion thereof defining a handle outside of said track being adapted to be grasped by the throwing hand of the user;

(c) means secured to and positioned adjacent said rear upright member for selectively applying a counterweight to said handle, said means for applying said counterweight comprising:

(i) a cable, having proximate and distal ends, mounted over a pulley, said means for movement being securable to to said proximate end of said cable and said counterweight, which comprises one of a series of removable weights, being securable to said distal end of said cable; and, (ii) a cylindrical sleeve within which said counterweight is housed;

(d) means secured to said front upright frame member and extending generally perpendicular thereto and adapted for gripping by the other hand of said user, whereby said user grasps sand handle and, against the bias of said counterweight, moves said means journalled within said track along said track; and, (e) a generally horizontal strut secured to each of said upright members, whereby the user positions himself adjacent said strut during use.

8. The apparatus of claim 7, wherein said pulley is mounted to the upper portion of said rear upright member.

9. The apparatus of claim 6, wherein said cylindrical sleeve is vertically mounted to said rear upright member.

10. The apparatus of claim 9, wherein said cylindrical sleeve is vertically mounted to said rear upright member below said pulley.

11. The apparatus of claim 8, wherein said cylindrical sleeve is vertically mounted to said rear upright member.

12. The apparatus of claim 11, wherein said cylindrical sleeve is vertically mounted to said rear upright member below said pulley.

* * * * *